US010584472B2

(12) United States Patent
Bledsoe

(10) Patent No.: US 10,584,472 B2
(45) Date of Patent: Mar. 10, 2020

(54) SEWER HOSE LINER AND RELATED METHODS

(71) Applicant: Jeffrey Bledsoe, Twenty-Nine Palms, CA (US)

(72) Inventor: Jeffrey Bledsoe, Twenty-Nine Palms, CA (US)

( * ) Notice: Subject to any disclaimer, the term of this patent is extended or adjusted under 35 U.S.C. 154(b) by 358 days.

(21) Appl. No.: 15/380,940

(22) Filed: Dec. 15, 2016

(65) Prior Publication Data

US 2017/0175934 A1 Jun. 22, 2017

Related U.S. Application Data

(60) Provisional application No. 62/269,649, filed on Dec. 18, 2015.

(51) Int. Cl.
*F16L 55/18* (2006.01)
*E03F 3/06* (2006.01)
*E03F 1/00* (2006.01)

(52) U.S. Cl.
CPC ..... *E03F 3/06* (2013.01); *E03F 1/008* (2013.01); *E03F 2003/065* (2013.01)

(58) Field of Classification Search
CPC ..... E03F 3/06; E03F 1/008; E03F 2003/065
USPC ..... 138/97, 98; 405/184.2, 150.1
See application file for complete search history.

(56) References Cited

U.S. PATENT DOCUMENTS 2,664,373 A 12/1953 Reilly
2,696,264 A 12/1954 Colmerauer et al.
3,457,920 A 7/1969 Thompson
3,936,890 A * 2/1976 Oberstein ..... A61G 9/003 4/452
4,133,347 A 1/1979 Mercer
4,223,702 A * 9/1980 Cook ..... E03F 1/008 137/355.12
4,643,229 A 2/1987 Hickin
4,723,579 A * 2/1988 Hyodo ..... B29C 63/343 138/119
4,770,562 A * 9/1988 Muller ..... F16L 55/1651 138/97
4,844,121 A 7/1989 Duke
5,919,002 A * 7/1999 Ramp ..... E03F 3/06 405/156
5,944,058 A * 8/1999 Kamiyama ..... F16L 55/265 138/97
6,042,668 A 3/2000 Kamiyama et al.
7,398,798 B2 7/2008 Ostan et al.
7,849,883 B2 12/2010 Manners
9,027,390 B1 * 5/2015 Rigby ..... E03F 7/00 73/40

(Continued)

FOREIGN PATENT DOCUMENTS

EP 0534588 3/1993

*Primary Examiner* — James F Hook
(74) *Attorney, Agent, or Firm* — Buche & Associates, P.C.; John K. Buche; Bryce A. Johnson

(57) ABSTRACT

This invention relates to a disposable sewer hose liner that may be used to line the inside of a sewer hose for recreational vehicles, trailers, and mobile homes. The disposable sewer hose liner provides a more sanitary method of disposing sewage and waste water from an RV, trailer, or mobile home and reduces the odor emanating from a sewer hose, the amount of cleaning necessary, and the amount of bacteria or waste that a user comes in contact with when interacting with a sewer hose.

17 Claims, 4 Drawing Sheets

(56) References Cited

U.S. PATENT DOCUMENTS

| | | | | |
|---|---|---|---|---|
| 9,587,781 | B1 * | 3/2017 | Abdulghafoor | F16L 55/165 |
| 2004/0256007 | A1 * | 12/2004 | Kennedy | B60R 15/04 137/355.12 |
| 2006/0137816 | A1 * | 6/2006 | Taylor | B29C 63/36 156/294 |
| 2006/0225802 | A1 * | 10/2006 | Kamiyama | F16L 55/1651 138/98 |
| 2009/0183794 | A1 * | 7/2009 | Kamiyama | F16L 55/179 138/98 |
| 2010/0006172 | A1 | 1/2010 | Bass et al. | |
| 2011/0197413 | A1 * | 8/2011 | Kiest, Jr. | F16L 55/1653 29/402.09 |
| 2014/0318671 | A1 * | 10/2014 | Swarts | E03F 1/008 141/382 |
| 2019/0211961 | A1 * | 7/2019 | Brundage | F16L 58/1018 |

* cited by examiner

SEWER HOSE LINER AND RELATED METHODS

CROSS-REFERENCE TO RELATED APPLICATIONS

This application claims the benefit and priority of U.S. Provisional Patent Application No. 62/269,649 filed on Dec. 18, 2015, entitled "Sewer Hose Liner and related Methods."

STATEMENT REGARDING FEDERALLY SPONSORED RESEARCH OR DEVELOPMENT

Not applicable.

FIELD OF THE INVENTION

This invention is in the field of sewer hose liners.

BACKGROUND OF THE INVENTION

Recreational vehicles ("RVs") and mobile homes are routinely used for camping trips, road trips, or can even serve as a temporary or permanent home. They are suitable for travel and living because they may have a kitchen or bathroom contained within the vehicle. Therefore, RVs and mobile homes generally feature a storage system for sewage and waste with an external hose that can connect to an RV and provide a means to empty the sewage and waste into a sewage disposal area. Generally, a hose is connected to an RV and to a sewage hookup to allow for sewage and waste to travel from the RVs to the sewage hookup. Therefore, when it is time to move the RV, the hose will need to be disconnected and stored on the RV. When disconnecting the sewer hose from the RV, the inside of the hose is littered with bacteria and fecal matter. Even if rinsed thoroughly, the hose can still be contaminated and give off an unpleasant odor. Therefore, a need exists for a disposable sewer hose liner that allows a user to line the hose before it is hooked up from an RV drain to the sewage disposal drain or site and when the sewer hose needs to be disconnected, the liner can be removed and disposed. Thus, the sewer hose liner reduces the problem of having bacteria and odor in the sewer hoses.

SUMMARY OF THE INVENTION

Accordingly, it is an object of the present invention to provide a sewer hose liner that reduces unwanted spread of bacteria and odor from the inside of the sewer hose, and that reduces the need and frequency to clean the sewer hose.

It is another object of the present invention to provide a disposable sewer hose liner that can be used with RV sewer hoses.

BRIEF DESCRIPTION OF THE FIGURES

Other objectives of the invention will become apparent to those skilled in the art once the invention has been shown and described. The manner in which these objectives can be achieved is explained in the following description and attached figures in which.

It is to be noted, however, that the appended figures illustrate only typical embodiments of the disclosed apparatus and are therefore not to be considered limiting of its scope, for the invention may admit to other equally effective embodiments that will be appreciated by those reasonably skilled in the relevant arts. Also, figures are not necessarily made to scale.

DETAILED DESCRIPTION OF PREFERRED EMBODIMENTS

Figure 1:
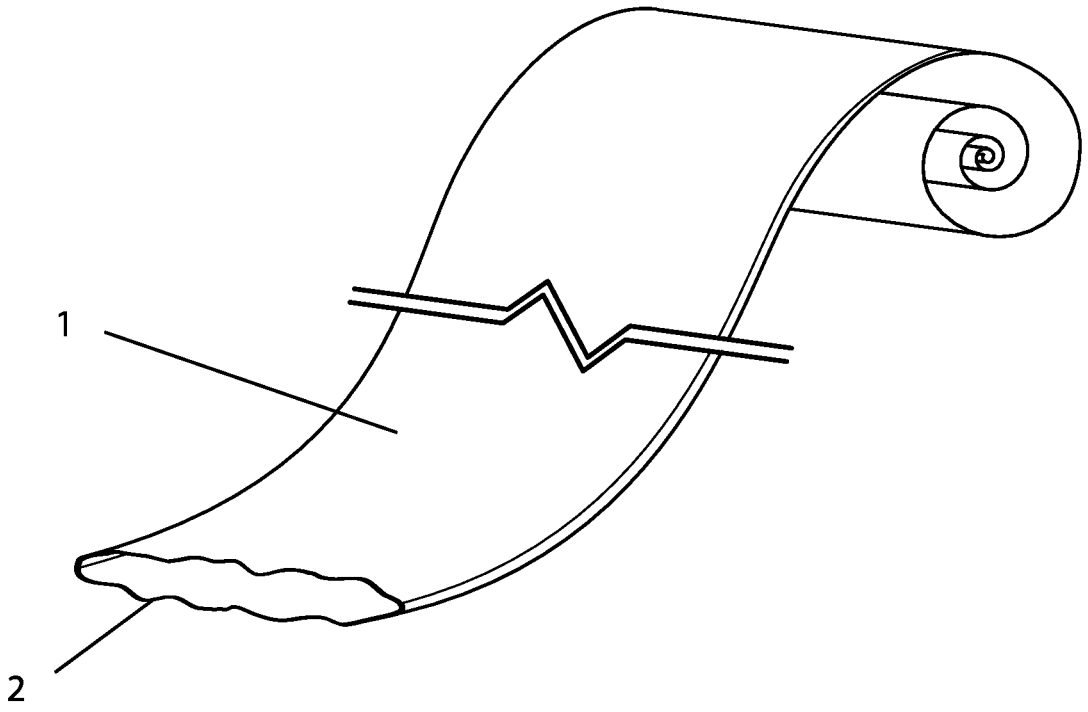
FIG. 1 is a perspective view of the sewer hose liner.

In general, disclosed is a sewer hose liner that can be used with RV sewer hoses. In a preferred embodiment, the sewer hose liner can reduce the mess and a user's contact with bacteria and waste matter associated with attaching, detaching, and cleaning sewer hoses for RVs, trailers, or mobile homes. In a preferred use, the liner can be passed through the hose by (1) putting a weight or an anchor in the end of the liner, (2) tying the liner closed, (3) threading the liner through the hose by dropping the weighted end through the hose, (4) pulling the liner through the other end, and (6) cuffing the end of the liner around the ends of the hose. Referring to FIG. 1, in one embodiment, the sewer hose liner 1 may be a sheath with a hollow central passage through which waste can travel. The sewer hose liner 1 has a first terminal end 2 and a second terminal end 6 (See FIG. 3). In a preferable embodiment, the sewer hose liner is disposable and can be cuffed around the ends of the sewer hose. The liner 1 may be composed of plastic, such as polyethylene, polypropylene, and nylon, or other non-porous, flexible, bio-degradable, or disposable material.

Figure 2:
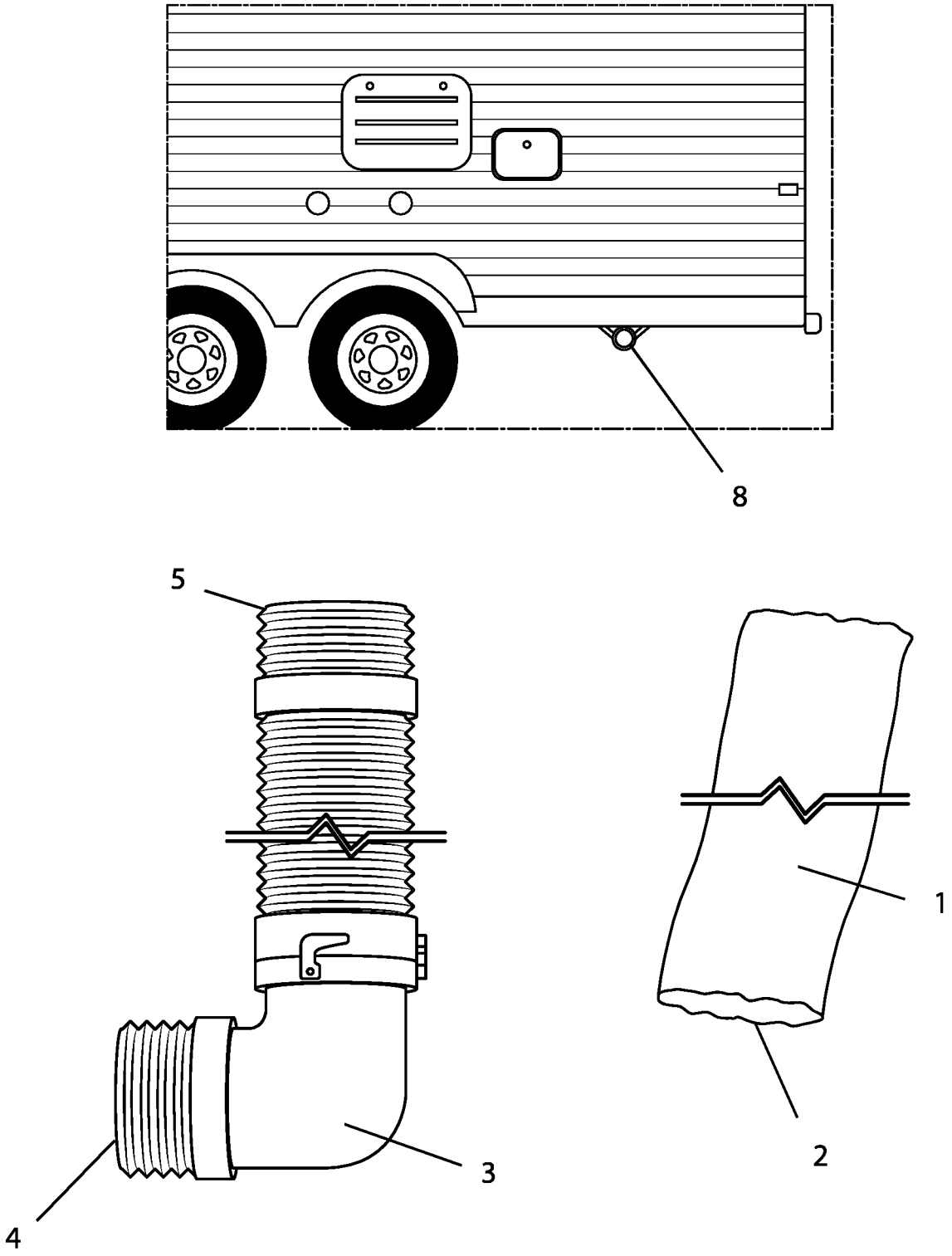
FIG. 2 is a perspective view of the sewer hose liner of FIG. 1, an RV, and a corresponding sewer hose.

Referring to FIG. 2, the sewer hose liner 1 is to be used with a sewer hose 3 with a first end 4 and a second end 5. The sewer hose 3 may be one commonly used with RV drains to connect an RV sewer drain 8 to a sewage disposal drain or site. FIGS. 2-5 depict one embodiment of a sewer hose 3 that may accept the sewer hose liner 1.

Figure 3:
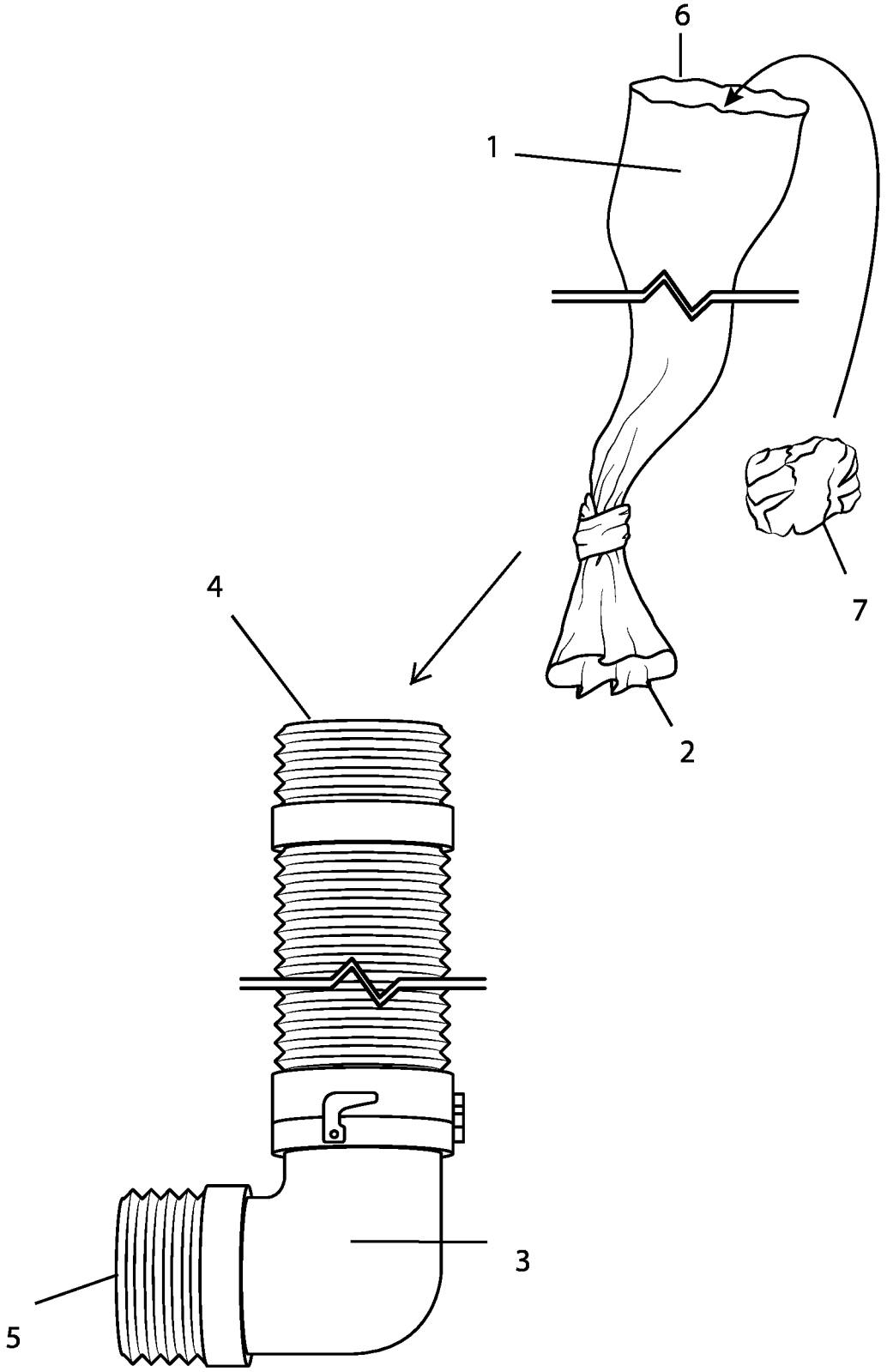
FIG. 3 is an illustration depicting one embodiment of using the sewer hose liner of FIG. 1.
Figure 4:
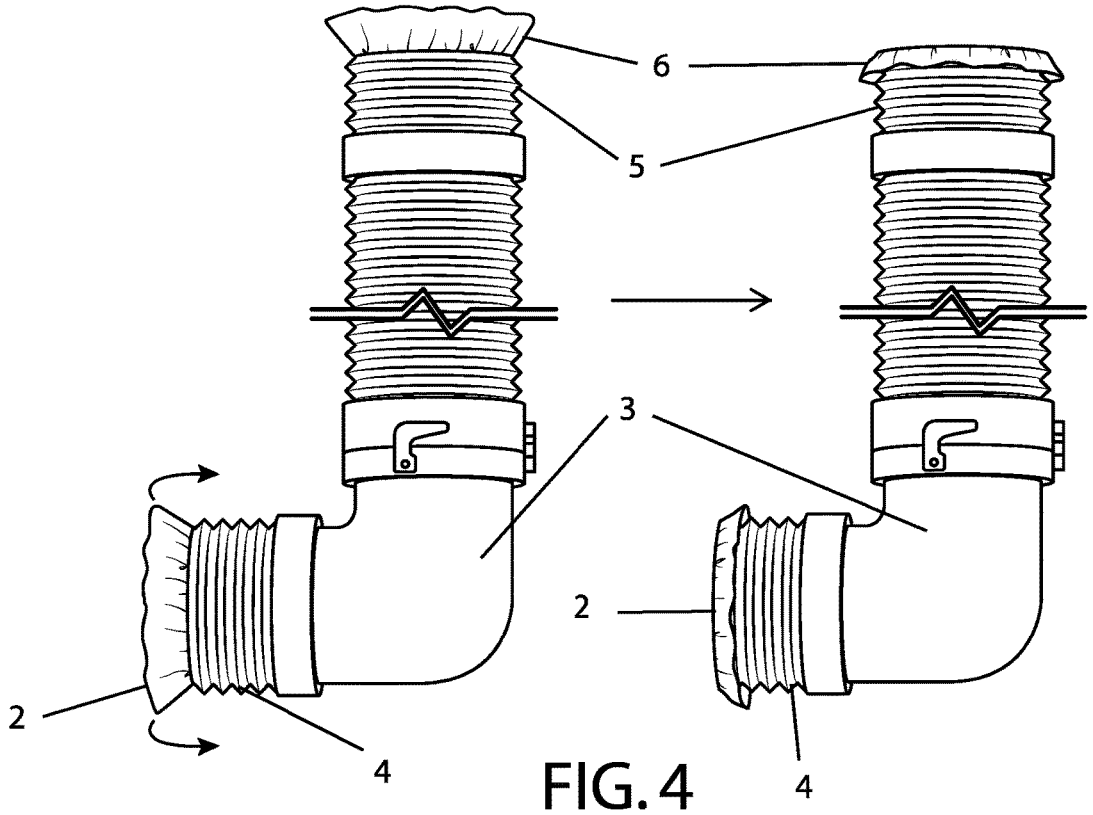
FIG. 4 is an illustration depicting one embodiment of using the sewer hose liner of FIG. 1 in a sewer hose; and, FIG. 5 is an illustration depicting one embodiment of a sewer hose employing the sewer hose liner of FIG. 1.
Figure 5:
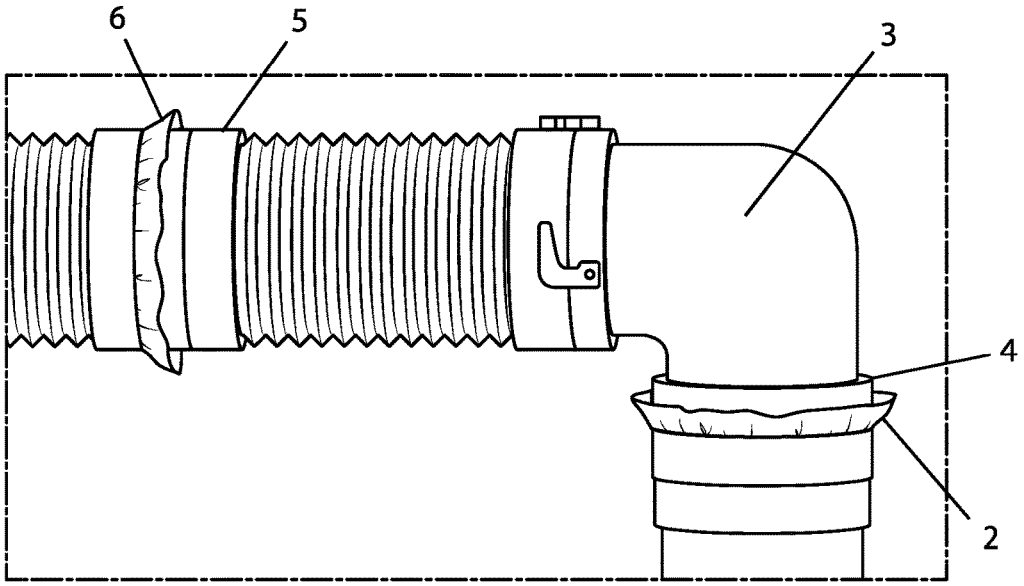

Referring to FIG. 3, in use, a preferred embodiment allows a user to close off a first terminal end 2 by tying a knot or by using a fastening device such as a zip tie, cable tie, rubber band, elastic tie, or any other means known to one of skill in the art. Once a first terminal end 2 is closed off, a user may place an anchor 7 into a second terminal end 6, and allow the anchor 7 to reach and come to a rest at the closed off first terminal end 2. With the anchor 7 at the first terminal end 2, a user may then insert the first terminal end 2 of the sewer hose liner 1 into the first end 4 of a sewer hose 3 and maneuver the sewer hose 3 so that the first terminal end 2 of the sewage liner 1 travels to the second end 5 of the sewer hose 3. Referring to FIG. 4, in a preferred embodiment, once the first terminal end 2 of the sewage liner 1 is threaded through the entire sewer hose 3, a user may open up the first terminal end 2, remove the anchor 7, and cuff the first terminal end 2 around the second end 5 of the sewer hose 3. The user then may cuff the second terminal end 6 of the sewer hose liner 1 around the first end 4 of the sewer hose 3. Referring to FIG. 5, the user may attach the first end 4 and the second end 5 of the sewer hose 3 to the respective sewage hookups on the RV drain 8 or the disposal drain or site, or allow one end to empty out into a disposal site. After a user empties out the sewage from an RV through the sewer hose 3, the user may disconnect the first and second ends 4,5 of the sewer hose 3, uncuff the first terminal end 2 and the second terminal end 6 from the sewer hose 3, remove the sewer hose liner 1 from the sewer hose 3, and then dispose of the sewer hose liner 1, thereby preventing sewage waste from coming in contact with the inside of the sewer hose 3. In one embodiment, before removing the sewer hose liner 1 from the sewer hose 3, a user may close off the first and second terminal ends 2,6 of the sewer hose liner 1 to reduce any sewage waste from escaping the sewer hose liner 1.

In one embodiment, the sewer hose liner 1 may be manufactured to a preset length to fit different sewer hoses 3. In an alternative embodiment, a user may cut the sewer hose liner 1 to fit any length of sewer hose. In another embodiment, the sewer hose liner 1 may have perforations on each end. In one embodiment the anchor 7 may be a rock or any other item with sufficient enough weight to travel through a sewer hose 3. In another embodiment, an anchor 7 or plurality of anchors 7 may be built into the perforations or other location on one or both ends of the sewer hose liner 1, which allows one end to have weight to be maneuvered through a sewer hose 3. In one embodiment, the first and second terminal ends 2,6 of the sewer hose liner 1 may be cuffed around the ends of the sewer hose 3 by wrapping them around the edges of the sewer hose 3, or by employing a securing device such as a zip-tie, rubber band, cable tie, or elastic tie. In another embodiment, an elastomeric band built into the edges of the first and second terminal ends 2,6 of the sewer hose liner 1, which allows them to be securely cuffed around the ends of a sewer hose 3.

It should be noted that those of skill in the art may appreciate alternate embodiments of the invention after reading this disclosure. This description of a preferred embodiment is not intended to be a limit to the scope of this disclosure. On the contrary, applicant contemplates many alternative embodiments that may be contrived and used without departing from the spirit and intent of this written description.

The claims filed herewith are incorporated by reference in their entirety into the specification as if fully set forth herein.

I claim:

1. A disposable sewer hose liner installed in a sewer hose of a recreational vehicle, said disposable sewer hose liner comprising:

a first end;

a second end;

and a hollow passage therebetween said first end and second end; and, wherein said sewer hose has a threaded elbow that is threadedly connected to a sewage disposal drain and a terminal end that is connected to a sewer drain of the recreational vehicle;

wherein said first end of said disposable sewer hose liner is cuffed over the terminal end so that a first cuff is exposed at and fixed between a connection of the terminal end and the sewer drain of the recreational vehicle; and, wherein said second end of said disposable sewer hose liner is cuffed over threads of the threaded elbow so that a second cuff is exposed at and fixed between a threaded connection of the threaded elbow and the sewage disposal drain.

2. The disposable sewer hose liner of claim 1, wherein the first and second end of the hose liner are open.

3. The disposable sewer hose liner of claim 1, wherein said hose liner is comprised of plastic.

4. The disposable sewer hose liner of claim 1, wherein said hose liner is bio-degradable.

5. The disposable sewer hose liner of claim 1, wherein an anchor is built into at least one end of the sewer hose liner.

6. A method of lining a sewer hose of a recreational vehicle comprising:

obtaining a sewer hose liner with a weighted end, a free end and a passageway therebetween said weighted end and said free end;

obtaining a sewer hose with a threaded elbow and a terminal end;

maneuvering one weighted end of said sewer hose liner through the terminal end of the sewer hose until said weighted end of said sewer hose liner is exposed at the threaded elbow;

cuffing the weighted end of said sewer hose liner around threads of the threaded elbow;

cuffing the free end of said sewer hose liner around the terminal end of the sewer hose;

connecting the terminal end of the sewer hose to a sewer drain of the recreational vehicle so that a first cuff is exposed at and fixed between a connection of the terminal end and the sewer drain of the recreational vehicle;

connecting the threaded elbow of the sewer hose to a sewage disposal drain so that a second cuff is exposed at and fixed between the connection of the threaded elbow and the sewage disposal drain; and, running sewage therethrough said sewer hose liner and sewer hose.

7. The method of claim 6, wherein a user detaches the sewer hose.

8. The method of claim 7, wherein the user ties-off the first and second end of the sewer hose liner.

9. The method of claim 8, wherein the user removes the sewer hose liner from the sewer hose.

10. The method of claim 9, wherein the user disposes the sewer hose liner.

11. The method of claim 6, wherein at least one end of the sewer hose liner is perforated.

12. The method of claim 6, wherein at least one end of the sewer hose liner is pre-weighted.

13. The method of claim 6, wherein the sewer hose liner is comprised of plastic.

14. The method of claim 6, wherein the sewer hose liner is disposable.

15. The method of claim 6, wherein the sewer hose liner is bio-degradable.

16. The method of claim 6, wherein at least one end of the sewer hose liner is fixed between the threads of the threaded elbow and threads of the sewage disposal drain.

17. A method of disposing sewage comprising:

obtaining a sewer hose liner with a first end and, a second end, and a hollow tube;

obtaining a sewer hose with a first end defined by a threaded elbow and a terminal end;

closing the first end of the sewer hose liner;

inserting a weight into the second end of a the sewer hose liner, wherein the weight is a rock;

maneuvering the weight to the closed first end of the sewer hose liner;

placing the weight and closed first end of the sewer hose liner into the terminal end of a sewer hose;

maneuvering the sewer hose to allow the weight and closed first end of the sewer hose liner to travel to the threaded elbow of the sewer hose;

pulling the weight and the closed first end of the sewer hose liner out of the threaded elbow;

opening the closed first end of the sewer hose liner;

removing the weight from the opened first end;

cuffing the open first end of the sewer hose liner over threads of the threaded elbow of the sewer hose;

cuffing the second end of the sewer hose liner over the terminal end of the sewer hose;

connecting the terminal end of the sewer hose to the sewage line hookups of a recreational vehicle so that a first cuff is exposed at and fixed between a connection of the terminal end and the sewer drain of the recreational vehicle;

connecting the threaded elbow of the sewer hose to a sewage disposal drain so that a second cuff is exposed at and fixed between the connection of the threaded elbow and the sewage disposal drain;

removing sewage waste from the recreation vehicle through the sewage liner;

disconnecting the sewer hose from the sewage line hookups;

disconnecting the sewer hose from the sewage disposal drain;

uncuffing the first and second end of the sewer hose liner from the sewer hose;

closing off the first and second end of the sewer hose liner by tying-off the first and second ends;

removing the sewer hose liner from the sewer hose; and, disposing the sewer hose liner.

* * * * *